United States Patent [19]

McCormick et al.

[11] Patent Number: 4,890,825

[45] Date of Patent: Jan. 2, 1990

[54] PAPER SHEET STACKING AND JOGGING APPARATUS

[75] Inventors: Walter A. (Sunny) McCormick, Bellevue; Douglas W. Langton, Seattle; Wilbur J. Kellum, III, Redmond; Thomas C. Saunders, Snohomish; Gregory Phillips, Seattle, all of Wash.

[73] Assignee: EMF Corporation, Redmond, Wash.

[21] Appl. No.: 144,539

[22] Filed: Jan. 15, 1988

[51] Int. Cl.[4] ..... B65H 29/70; B65H 31/10; B65H 31/36

[52] U.S. Cl. ..... 271/188; 271/209; 271/215; 271/217; 271/221

[58] Field of Search ..... 271/209, 215, 217, 221, 271/222, 188

[56] References Cited

U.S. PATENT DOCUMENTS

| | | | |
|---|---|---|---|
| 2,919,917 | 1/1960 | Worswick | 271/64 |
| 2,922,640 | 1/1960 | Fornell et al. | 270/58 |
| 3,166,313 | 1/1965 | Rehm | 271/86 |
| 3,385,457 | 5/1968 | Zinn | 214/6 |
| 3,434,710 | 3/1969 | Yarger et al. | 271/188 |
| 3,682,328 | 8/1972 | Turner et al. | 271/215 |
| 3,709,480 | 1/1973 | Schulze et al. | 270/58 |
| 3,774,906 | 11/1973 | Fagen et al. | 271/64 |
| 3,802,694 | 4/1974 | Post et al. | 270/58 |
| 3,841,754 | 10/1974 | Drexler et al. | 355/17 |
| 3,937,459 | 2/1976 | Lawrence | 271/173 |
| 3,944,217 | 3/1976 | Greene et al. | 271/173 |
| 3,973,769 | 8/1976 | Cross et al. | 271/173 |
| 3,977,667 | 8/1976 | Cross et al. | 271/64 |
| 3,988,018 | 10/1976 | Tusso et al. | 271/173 |
| 3,990,695 | 11/1976 | Cross et al. | 271/64 |
| 3,997,154 | 12/1976 | Mol | 271/215 |
| 4,015,841 | 4/1977 | Mitsumasu | 271/173 |
| 4,019,640 | 4/1977 | Marin et al. | 271/209 X |
| 4,046,371 | 9/1977 | Sevak | 271/178 |
| 4,047,472 | 9/1977 | Haberstroh | 93/93 D |
| 4,047,713 | 9/1977 | Snellman et al. | 271/221 |
| 4,157,822 | 6/1979 | Miller | 271/3.1 |
| 4,204,727 | 5/1980 | Tates | 355/3 R |
| 4,221,379 | 9/1980 | Kamath et al. | 271/289 |
| 4,228,995 | 10/1980 | Breuers et al. | 271/292 |
| 4,232,861 | 11/1980 | Maul | 271/287 |
| 4,248,525 | 2/1981 | Sterrett | 355/14 SH |
| 4,297,025 | 10/1981 | Bach et al. | 355/145 H |
| 4,318,542 | 3/1982 | Altmann et al. | 271/290 |
| 4,344,614 | 8/1982 | Kaneko et al. | 271/288 |
| 4,352,490 | 10/1982 | Hatakeyama | 271/289 |
| 4,359,219 | 11/1982 | Garavuso | 271/236 |
| 4,428,572 | 1/1984 | Burke | 271/297 |
| 4,454,440 | 6/1984 | Fagan et al. | 271/3.1 |
| 4,469,323 | 9/1984 | Miyashita et al. | 271/288 |
| 4,496,143 | 1/1985 | Weyer | 271/112 |
| 4,498,665 | 2/1985 | Watanabe | 271/289 |
| 4,515,458 | 5/1985 | Masuda et al. | 355/3 SH |
| 4,530,593 | 7/1985 | Kasuya et al. | 355/14 R |
| 4,570,922 | 2/1986 | Akers | 271/215 X |
| 4,578,582 | 3/1986 | Takano | 250/327.2 |
| 4,589,654 | 5/1986 | Kanoto | 271/314 |
| 4,667,809 | 5/1987 | Raybuck | 198/456 |
| 4,687,193 | 8/1987 | Scarabino et al. | 271/271 X |

FOREIGN PATENT DOCUMENTS

| | | | |
|---|---|---|---|
| 1494325 | 12/1977 | United Kingdom | 15/58 |

*Primary Examiner*—Joseph J. Rolla
*Assistant Examiner*—Mona Beegle
*Attorney, Agent, or Firm*—Patrick Michael Dwyer; David L. Garrison

[57] ABSTRACT

The present invention comprises a paper sheet stacking and jogging apparatus for the semi-continuous stacking and jogging of individually fed sheets of paper from devices such as printing or duplicating machinery. A conveyor, comprising a pair of powered forward pinch rollers and a pair of powered rearward pinch rollers each having a plurality of driving tires, conveys the sheets within the apparatus. A beam strengthener, comprising two pairs of crowned and recessed tires, which are not driving tires, give the sheets beam strength as they are deposited to prevent jamming of the apparatus. A high-capacity, self-leveling tray assembly and elevating elevator receives the deposited sheets. A jogger selectively jogs the sheets which are deposited into the tray assembly into physically separated, distinct, aligned job stacks.

24 Claims, 10 Drawing Sheets

PAPER SHEET STACKING AND JOGGING APPARATUS

TECHNICAL FIELD

This invention relates to a paper sheet stacking and jogging apparatus used to transport, stack, and jog individually fed sheets of paper into physically separated, easily defined job stacks within a single, large-capacity tray assembly. More specifically, the present invention relates to a paper sheet stacking and jogging apparatus which conveys, bends, stacks and jogs paper sheets which are individually fed from a large-volume, high-speed, document printing or duplicating device.

BACKGROUND ART

Within the printing and photocopying industries there has been a great need for various types of sheet handling equipment, including stacking and jogging apparatus. Numerous sorting, collating, and jogging devices, created in an attempt to meet that need, have been disclosed in issued patents. Commonly assigned patents Fagan et al. (U.S. Pat. No. 3,774,906) and Greene et al. (U.S. Pat. No. 3,944,217) disclose two types of paper sheet sorting and collating devices having various conveyor belt systems, deflecting mechanisms, and multiple receiving trays.

Fornell et al. (U.S. Pat. No. 2,922,640) discloses a collating machine having a traveling drum depository or bin.

Schulze et al. (U.S. Pat. No. 3,709,480), Post et al. (U.S. Pat. No. 3,802,694), Drexler et al. (U.S. Pat. No. 3,841,754), Lawrence (U.S. Pat. No. 3,937,459), Cross et al. (U.S. Pat. No. 3,973,769), Cross et al. (U.S. Pat. No. 3,977,667), Tusso et al. (U.S. Pat. No. 3,988,018), Cross et al. (U.S. Pat. No. 3,990,695), Tates (U.S. Pat. No. 4,204,727), Kamath et al. (U.S. Pat. No. 4,221,379), Breuers et al. (U.S. Pat. No. 4,228,995), Sterrett (U.S. Pat. No. 4,248,525), Kaneko et al. (U.S. Pat. No. 4,344,614), Hatakeyama (U.S. Pat. No. 4,352,490), Burke (U.S. Pat. No. 4,428,572), Miyashita et al. (U.S. Pat. No. 4,469,323), Watanabe (U.S. Pat. No. 4,498,665), Masuda et al. (U.S. Pat. No. 4,515,458), Kasuya et al. (U.S. Pat. No. 4,530,593), and Tankano (U.S. Pat. No. 4,578,582) disclose various sorting or collating devices wherein the paper sheets are deposited into vertically indexed, generally horizontal receiving trays.

Worswick (U.S. Pat. No. 2,919,917), Mitsumasu (U.S. Pat. No. 4,015,841), Maul (U.S. Pat. No. 4,232,861) and Altmann et al. (U.S. Pat. No. 4,318,542) disclose sorting or distributing devices having a means to horizontally transport paper sheets through the apparatus and deflect the sheets into horizontally indexed, vertically inclined sorting or receiving bins. The transporting means include pinch rollers and/or conveyors.

The following disclosures relate to jogging devices:

Rehm (U.S. Pat. No. 3,166,313) discloses a device for stacking and jogging vertically oriented material, such as mail shipments, against a stationary wall. A single brush roller having multiple elastic bristles engages the lower portions of the shipments, moving them against the stationary wall. Two circular discs are provided on the roller above and below the bristles to limit the flexing movement of the bristles in the axial direction of the roller.

Zinn (U.S. Pat. No. 3,385,457) discloses a mechanism having a stop plate which experiences intermittent, lateral, inward and outward movement to tap one side of the top sheet into alignment with the other sheets in a stack.

Sevak (U.S. Pat. No. 4,046,371) discloses a sheet stacking device used to stack documents on edge as they are serially ejected into preselected sorting pockets. A pair of spaced-apart paddle wheels, coaxially disposed subjacent to the pocket, rotate in 90 degree steps through apertures formed in the pocket to kick the trailing end of each document toward a movable, biased backup plate.

Haberstroh (U.S. Pat. No. 4,047,472) discloses a rotating disc having one or more flexible strips which rotate between vertically stacked documents.

Snellman et al. (U.S. Pat. No. 4,047,713) discloses a sheet jogger which mechanically taps one side of the top sheet against stops to align the sheets in a stack.

Garavuso (U.S. Pat. No. 4,359,219) discloses a direct control paddle wheel apparatus for document corner registration including a paddle wheel with multiple blades that drive a document into registration with intersecting walls. The blades, as they rotate, are channeled to drive a document from side to side, as well as straight ahead depending on the shape of the plate or barrier.

Kanoto (U.S. Pat. No. 4,589,654) discloses a device for aligning conveyed sheets against two substantially orthogonal surfaces by using a main and an auxiliary rotatable paddle member. Each paddle member has a plurality of flexible members. The main paddle member is positioned to impart a sheet draw-in force in the direction of intersection of the two orthogonal surfaces.

Raybuck (U.S. Pat. No. 4,667,809) discloses an apparatus for aligning a moving stream of overlapping signatures. A pair of elongated endless jogger belts, mounted on supporting bases on opposite sides of the moving stream of sheets, tap the sides of the sheets into alignment with one another.

These disclosures are believed to illustrate the general scope of the prior art related to paper stacking and jogging equipment. The applicants submit that these disclosures, taken alone or together, do not teach the concepts embodied in this invention.

DISCLOSURE OF INVENTION

It is a general object of the present invention to provide a paper sheet stacking and jogging apparatus capable of conveying, stacking and jogging individually fed sheets of paper, received from a printing or copying device, into physically separated, easily defined job stacks on a large-volume, high-speed, semi-continuous basis.

A further object is to provide an apparatus which minimizes jamming of sheets during operation.

A still further object is to provide an apparatus having a conveying means for conveying the sheets into the apparatus.

Another object is to provide an apparatus, wherein the conveying means has a sheet-jamming or sheet-delivery sensing means.

Another object is to provide an apparatus having a beam strengthening means to bend the sheets and give the sheets beam strength as they are deposited within the apparatus.

Another object is to provide an apparatus having a tray assembly wherein the sheets may be stacked.

Another object is to provide an apparatus, wherein the tray assembly is capable of receiving and storing a large quantity of stacked sheets.

Another object is to provide an apparatus having a tray assembly with a bin-full or capacity sensing means.

Another object is to provide an apparatus having a tray assembly with a removable tray floor.

Another object is to provide an apparatus having a jogging means capable of jogging the sheets deposited within the tray assembly into physically separated, easily defined, multiple job stacks.

Another object is to provide an apparatus, wherein the jogging means has only one jogging motor.

Another object is to provide an apparatus, wherein the jogging means is attached to a hinged canopy which may be raised from the tray assembly to allow for maintenance of the apparatus and for removal of any jammed or damaged sheets.

Another object is to provide an apparatus having an access door capable of allowing visual inspection of the separation of the job stacks during operation.

The present invention allows for the semi-continuous conveying, stacking and jogging of large quantities of individually fed sheets of paper into physically separated, easily defined multiple job stacks. More specifically, the invention is a paper sheet stacking and jogging apparatus capable of conveying individually fed sheets of paper toward a tray assembly, bending the sheets to give the sheets beam strength as they are being deposited within the tray assembly, and jogging the sheets within the tray assembly into physically separated, easily defined job stacks. To achieve these ends, the paper sheet stacking and jogging apparatus has a conveying means, a beam strengthening means, a tray assembly, and a jogging means.

Individual sheets, received from a source such as a high-speed printing or duplicating device, are introduced into an entrance opening of a support frame, cabinet, or enclosure which houses the paper sheet stacking and jogging apparatus. The apparatus may be secured to the sheet supply source with a securing means. The securing means may comprise either a hard or soft docking system. The hard docking system may be a bolt, clamp, or other appropriate securing device which joins the support frame to the printing or duplicating device. The soft docking system comprises at least one mating pin and at least one magnet. The mating pin assists in establishing the proper interface between the support frame and the sheet supply source. The magnet removably secures the apparatus to the supply source which facilitates their easy joining and separation. A sheet guiding means located at the entrance opening directs the sheets toward the conveying means.

The conveying means comprises a positive drive mechanism, having a pair of forward pinch rollers and a pair of rearward pinch rollers, which conveys the sheets into the enclosure and delivers the sheets at a regulated speed onto the tray assembly. The forward and rearward pinch rollers are rotatably secured to the support frame and are powered by a single driving motor. At least one set of interengaging driving tires is attached to the forward and rearward pinch rollers. The sheets are received and conveyed between the nips of the driving tires on each pair of pinch rollers.

The forward pinch rollers are positioned within the enclosure immediately adjacent to the entrance opening into which the sheets are fed. As the sheets enter the enclosure, the sheet guiding means directs the sheets toward the forward pinch rollers. The driving tires of the forward pinch rollers engage the sheets and convey the sheets, with the directional assistance of the sheet guiding means, toward the rearward pinch rollers and the beam strengthening means located further within the enclosure adjacent to the tray assembly.

As the sheets are conveyed toward the rearward pinch rollers and beam strengthening means, a sheet-jamming or sheet-delivery sensing means verifies that the sheets are properly conveyed. A light activated delivery switch may be used for this purpose to detect the continuity of a delivery optical path located near and upstream from the rearward pinch rollers and the beam strengthening means. The sheet-delivery sensing means is triggered when a sheet is not properly fed onto the tray assembly. When triggered, the sheet-delivery sensing means activates an operator warning signal and the operation of the apparatus is terminated until the problem is corrected.

The driving tires of the rearward pinch rollers drive the sheets through the beam strengthening means into a position above the tray assembly. The forward and rearward pinch rollers also regulate the speed of the sheets as they are conveyed to the tray assembly. Controlling the sheet conveying speed is important to ensure that the jogging means properly engages each sheet after deposition within the tray assembly.

The beam strengthening means, comprising two pairs of matched crowned and recessed tires between which the sheets are fed, is located upon the rearward pair of pinch rollers adjacent to the driving tires. In the preferred embodiment, the driving tires of the rearward pinch rollers are located between two pairs of matched crowned and recessed tires. The beam strengthening means bends or recurls the sheets as they pass between the driving tires of the rearward pinch rollers. The beam strengthening means gives the sheets sufficient beam strength to enable the sheets to cantilever over the receiving surface of the tray assembly. The sheets are then directed onto the receiving surface of the tray assembly by gravity and a pair of paper bails. The bending of the sheets ensures the proper delivery of the sheets onto the receiving surface of the tray assembly. The crowned and recessed tires are not driving tires and exert minimum conveying forces on the sheets. This helps to minimize the impressing or marking of the sheets as they pass between the crowned and recessed tires, and avoids the snapping sound otherwise present. A space which is approximately the thickness of a single sheet of paper is provided between the crowned and recessed tires to minimize the driving forces exerted by the crowned and recessed tires.

The tray assembly serves as a depository where the sheet may be stacked into separated, easily defined, job stacks. The tray assembly is designed to support a large quantity of stacked sheets which may be removed from within the enclosure through an access door opening in the support frame. The tray assembly comprises a tray floor and a tray side wall. The tray floor serves as a receiving surface or platform upon which the sheets are stacked. The uppermost stacked sheet forms the tray receiving surface upon which the next successive sheet is stacked. The stacked sheets are supported by the tray floor, which may be removably secured to the support frame within the enclosure. The tray side wall is securely attached to the support frame and defines a first stationary stopping means against which the sheets may be urged.

As the sheets are being cantilevered over the receiving surface of the tray assembly, the sheets are directed downward by gravity and a pair of paper bails until the sheets are deposited upon the sheet receiving surface. Each newly deposited sheet is juxtaposed between the top of the stack and the paper bails. The paper bails hold down the sheets within the stack. The paper bails may be counterbalanced with weights or supported by springs so that they do not rest too heavily upon the top sheet of the stack.

An elevating means for raising or lowering the tray floor is provided to cause the sheet receiving surface to remain in close proximity to the cantilevered sheets and beam strengthening means. The elevating means comprises an elevational motor and a tracking means to enable the high-capacity, self-leveling tray assembly to be vertically raised or lowered. As the sheets are deposited, a sheet-elevation sensing means activates the elevating means to raise or lower the tray floor as needed. A light activated elevational switch may be used to indicate when the tray floor needs to be raised or lowered. In the preferred embodiment, the position of the paper bails is used to interrupt the continuity of an elevational optical path which activates an elevational switch.

The large-capacity tray assembly allows "semi-continuous operation" of the apparatus. Due to the large receiving capacity of the tray assembly, sufficient time is allowed during operation for the continuous stacking and jogging of a large quantity of sheets before the tray assembly becomes full and the stacked sheets need to be removed. The sheets may be deposited within the tray assembly until the lowering of the tray floor activates a bin-full or capacity sensing means. The capacity sensing means prevents overstacking and jamming of the tray assembly. In the preferred embodiment, the capacity sensing means is triggered by the proximity of the tray floor to a lower trip switch located near the base of the support frame. Once triggered, the capacity sensing means causes the activation of an operator warning signal and terminates the operation of the sheet stacking and jogging apparatus until at least some of the stacked sheets are removed from the tray assembly. The sheets may be removed through the access door opening. Quick and easy removal of the sheets may also be achieved by using a tray floor which is removably attached to the tray assembly. In which case, both the tray floor and the stacked sheets are withdrawn from within the enclosure through the access door opening. The tray floor may then be quickly emptied and/or replaced and the operation continued.

Once a sheet has triggered the sheet-delivery sensing means, a time delay is provided to allow each incoming sheet to become deposited onto the receiving surface of the tray assembly before the jogging means is activated.

The jogging means is provided to facilitate the proper alignment of the deposited sheets into uniform job stacks. The jogging means jogs each newly deposited top sheet of the sheet stack into a registered position against either a first or second set of stopping means, with the next lower sheet remaining quiescent. The jogging means comprises: a jogging motor; two flexible, elastomeric jogging fingers mounted in separate chucks; and a first and a second set of two orthogonally oriented, variably positioned stopping means. The jogging fingers rotate on axes which are perpendicular to one another and, preferably, parallel to the receiving surface of the tray assembly. If necessary, the axes may be positioned at a slight angle to the receiving surface of the tray assembly.

In the preferred embodiment, the jogging means is driven by a single jogging motor mounted to the support frame. The first or primary jogging finger is mounted upon a primary chuck. The primary chuck is directly attached to a primary shaft which in turn is attached to the rotating shaft of the jogging motor. The second or auxiliary jogging finger is mounted upon an auxiliary chuck. The auxiliary chuck is attached to an auxiliary shaft. The auxiliary shaft is rotatably engaged to the primary shaft at approximately a 90 degree angle by a pair of meshed, beveled gears. One of the gears is securely attached to the primary shaft, thereby sharing the same axis of rotation with the shaft of the jogging motor. The other gear is securely attached to the auxiliary shaft and is rotatably journaled upon the support frame.

When the jogging means is activated, the jogging motor rotates the pivotal chucks a given number of revolutions. This causes the jogging fingers, which are attached to the chucks, to rotate and pass across the top of the last deposited sheet with a gentle wiping motion, gently urging the top sheet toward a backstop or stopping means. The jogging fingers do not continually rotate. Rather, the jogging fingers rotate only a limited number of complete turns each time a sheet is fed onto the stack. Preferably, the jogging fingers rotate only once or twice for each deposited sheet. By rotating only a limited number of times for each deposited sheet, the present invention prevents excessive smearing of any ink that might be on the paper sheets. Smearing of the ink may occur if the jogging mechanism continually rotates. The rotational speed of the jogging fingers and number of rotations per sheet may be adjusted to accommodate the jogging of different weights and textures of paper. The jogging fingers stop rotating after the designated number of turns has been achieved to await the deposit of another sheet upon the tray assembly.

To further reduce the likelihood of smearing the ink on the sheets, the rotated jogging fingers do not contact the sheet at the same time. Rather, the extended jogging fingers are rotationally offset from one another. The primary and auxiliary jogging fingers rotate at the same rotational speed.

The sheets being stacked and jogged within the tray assembly may be jogged into physically separated, distinct, easily identifiable, and easily defined job stacks. Job separation is obtained by causing the primary and auxiliary jogging fingers to move the sheets until the sheets are aligned and registered against either a first or a second set of two orthogonally oriented stopping means. The first and the second set of stopping means each have a combination of stationary and solenoid driven stopping means. The first set of two orthogonally oriented stopping means includes a first stationary stopping means, and a first solenoid-driven stopping means. The second set of two orthogonally oriented stopping means includes a second stationary stopping means, and a second solenoid-driven stopping means. The first stationary stopping means is defined by the tray side wall of the tray assembly, which is located opposite from the beam strengthening means. The second stationary stopping means is defined by a protrusion of the support frame located near an interior side of the access door opening, which is positioned to traverse the plane defined by the sheet receiving surface.

When disengaged, the first and second solenoid-driven stopping means are biased upward out of the path of the deposited sheets. When engaged, the first solenoid-driven stopping means pivots or lowers to rest upon the sheet receiving surface of the tray assembly. When so engaged, the first solenoid-driven stopping means holds the top sheet of the lower job stack quiescent, and defines a different stopping means against which the sheets of the next job stack may be urged. To accomplish job separation, the first solenoid-driven stopping means is positioned or inset about a half of an inch from the location of the second stationary stopping means toward the center of the sheet receiving surface. When the first solenoid-driven stopping means is disengaged, the second solenoid-driven stopping means is automatically engaged.

When engaged, the second solenoid-driven stopping means likewise pivots or lowers to rest upon the sheet receiving surface of the tray assembly, holds the top sheet of the lower job stack quiescent, and defines an alternative stopping means against which the sheets of the next job stack may be urged. The second solenoid-driven sopping means is similarly positioned or inset about a half of an inch from the location of the first stationary stopping means toward the center of the sheet receiving surface. When the second solenoid-driven stopping means is disengaged, the first solenoid-driven stopping means is automatically engaged.

The access door opening may be closed or covered by an access door. The access door may have a window, visual porthole, or slot to allow the visual inspection of the remaining tray capacity and allow the verification of proper job separation during the operation of the apparatus.

The jogging means may be positioned upon a hinged canopy which can be raised or lifted above the tray assembly. Raising of the jogging means allows for easy maintenance of the apparatus, and allows the removal of the stacked sheets and any jammed or damaged sheets from within the enclosure. A single magnetic-continuity safety switch may be placed on the support frame to activate an appropriate operator warning device and terminate the operation of the apparatus if either the canopy or access door are opened during operation of the apparatus.

BEST MODE FOR CARRYING OUT THE INVENTION

Figure 1:
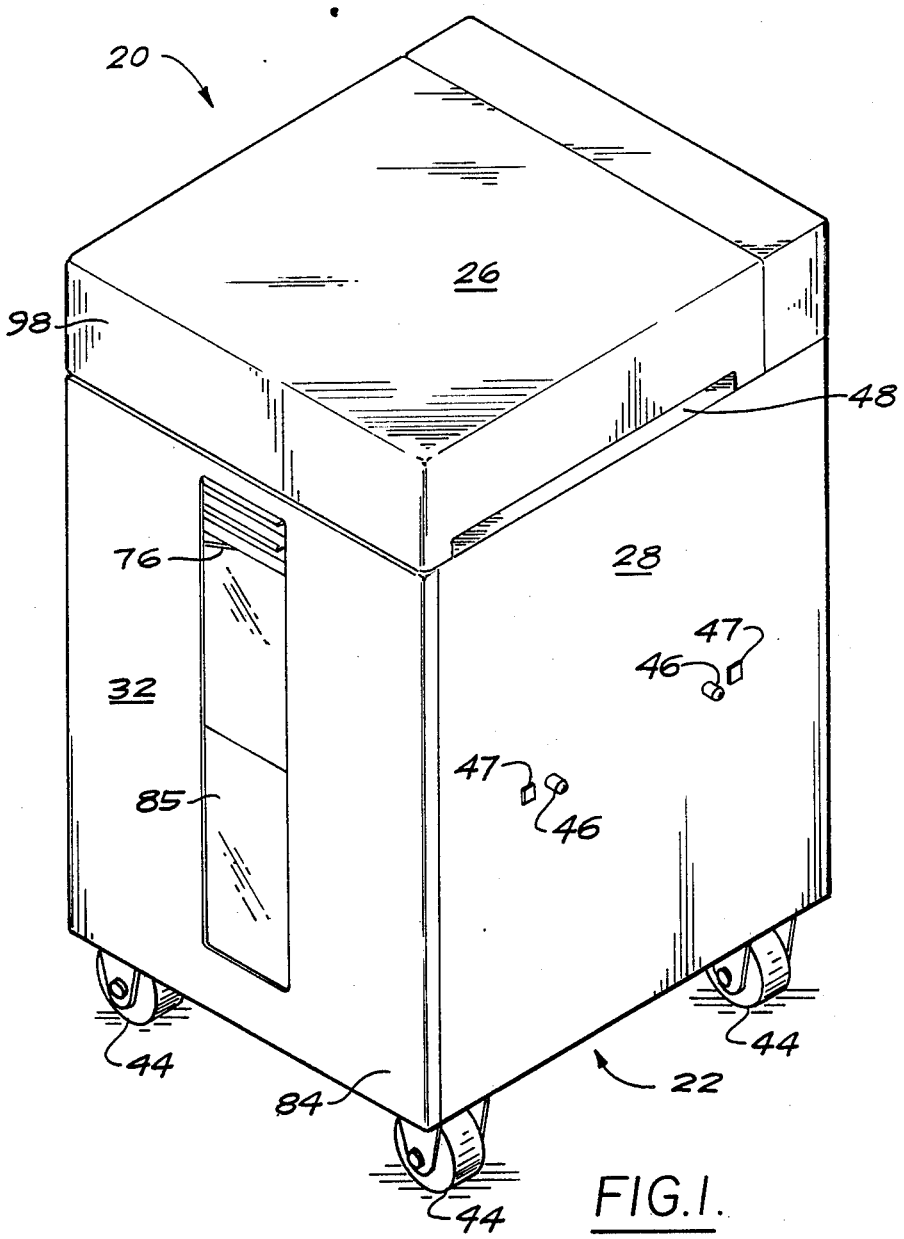
FIG. 1 is a perspective view of the preferred embodiment of the paper sheet stacking and jogging apparatus made in accordance with this invention.
Figure 2:
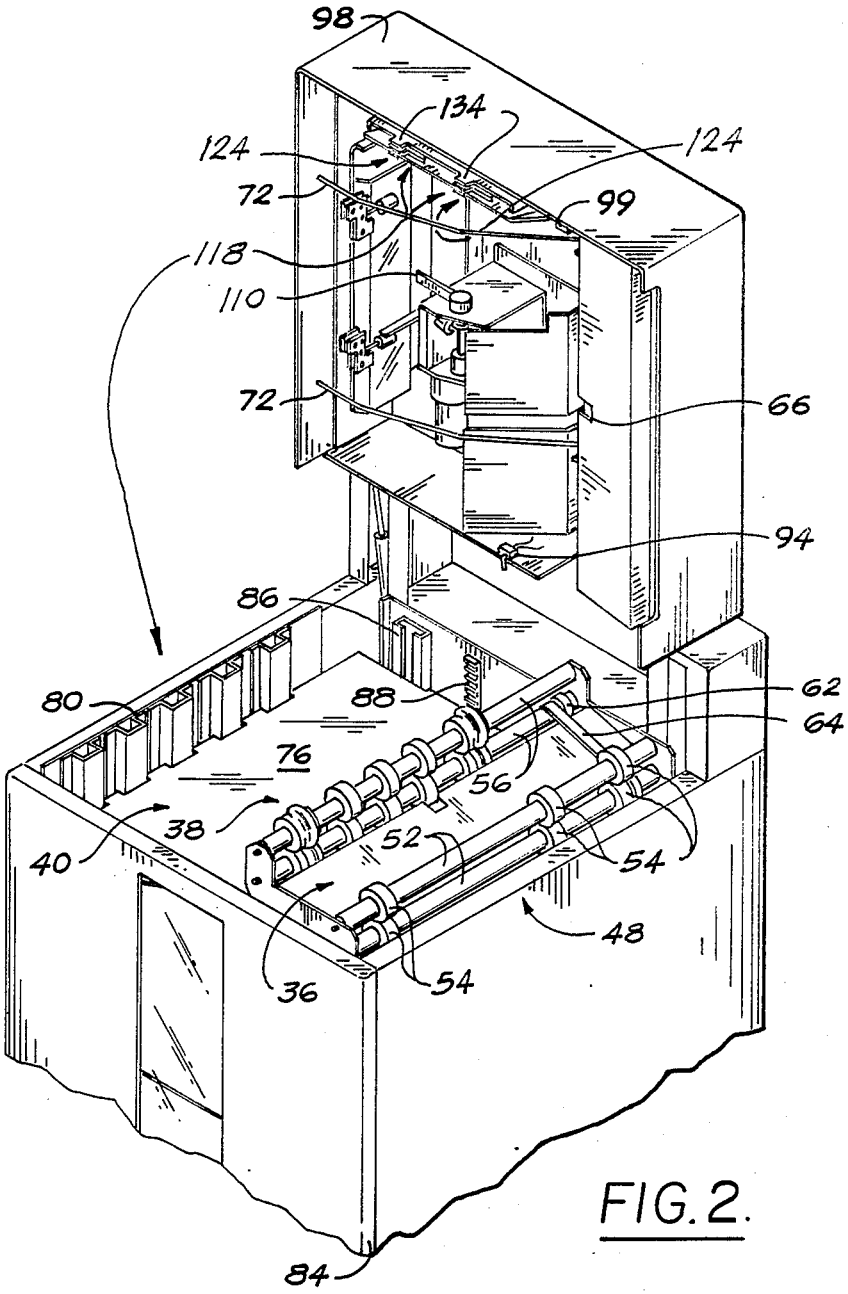
FIG. 2 is a partial perspective view of the present invention as shown in FIG. 1 with the jogging means being located upon a raised, hinged canopy.

Referring to the drawings and particularly to FIG. 1, wherein like numerals indicate like parts, the paper sheet stacking and jogging apparatus 20 has an upstanding, generally rectangular support frame 22. Support frame 22 defines an enclosure which has a base 24, a lid 26, an entrance wall 28, a side wall 30, a front wall 32, and a back wall 34. Located within the enclosure is a conveying means 36, a beam strengthening means 38, a tray assembly 40, and a jogging means 42.

Support frame 22 may sit directly upon the floor, upon leveling pedestals, or upon caster wheels 44. If caster wheels 44 are used, support frame 22 should be secured to the feeding or supply source to ensure the proper feeding of the sheets into the enclosure. Securing apparatus 20 to the supply source may be accomplished by using a securing means which is attached to support frame 22. The securing means may comprise either a hard or soft docking system. The hard docking system may be a bolt, clamp, or other appropriate securing device which secures apparatus 20 to the feeding or supply source. The soft docking system comprises at lease one mating pin 46 and at least one magnet 47. Mating pin 46 is secured to entrance wall 28 by any conventional means. Mating pin 46 is positioned to mate into a hole provided in the supply source, such that, when mated, the sheets are properly fed into the enclosure. Mating pin 46 prevents the lateral misalignment between apparatus 20 and the supply source. Magnet 47, which preferably comprises a permanent magnet, is secured to entrance wall 28 to removably secure apparatus 20 to the supply source. The applicants prefer using the soft docking system because it allows the proper, secured interface between apparatus 20 and the sheet supply source, and allows for their easy joining and separation.

Figure 4:
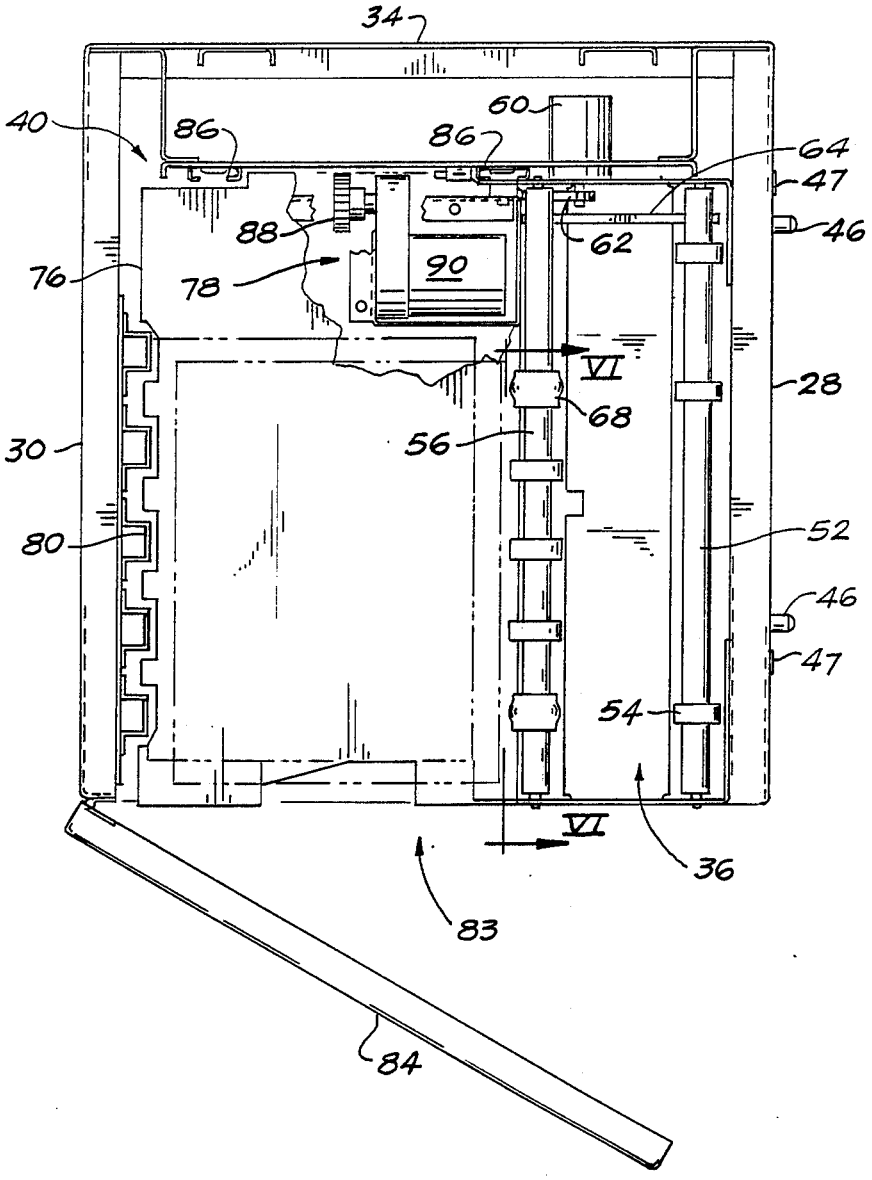
FIG. 4 is a plan view of the conveying means, beam strengthening means, and tray assembly of the device shown in FIGS. 2 and 3.
Figure 5:
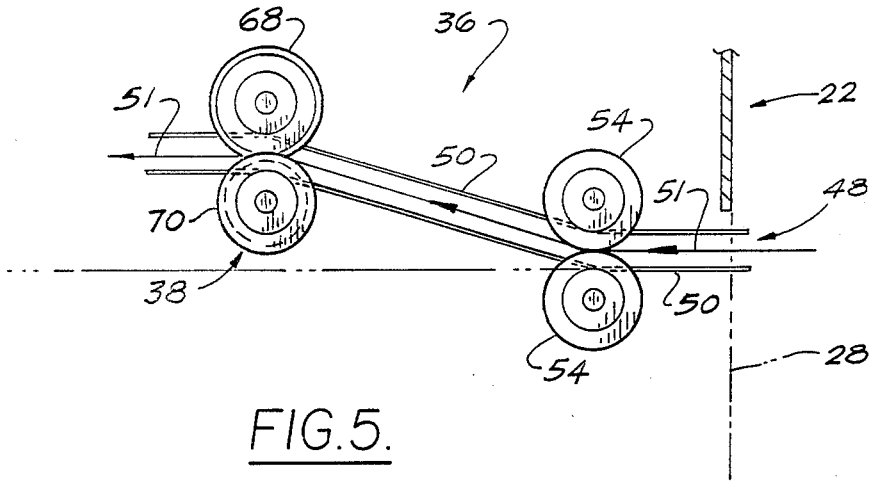
FIG. 5 is a schematic side elevational view of a sheet passing through the conveying means and beam strengthening means shown in FIGS. 2, 3 and 4.
Figure 6:
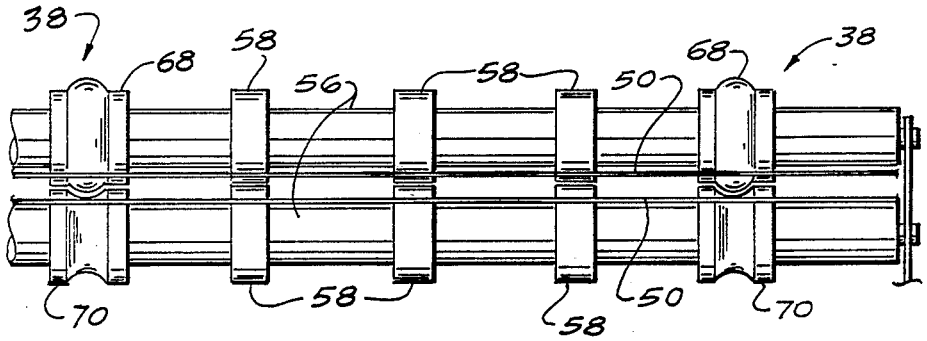
FIG. 6 is a partial side elevational view of the beam strengthening means as shown in FIG. 4 at the plane defined by Line VI—VI.
Figure 7:
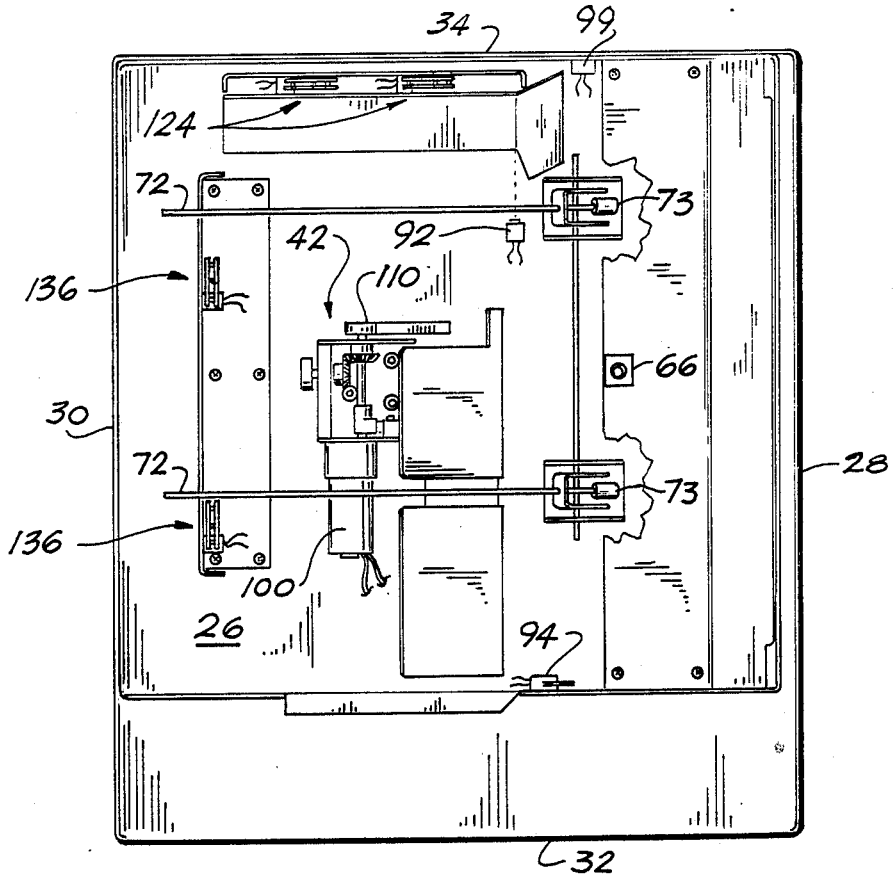
FIG. 7 is a bottom plan view of the canopy showing the jogging means with a portion broken away for clarity.
Figure 8:
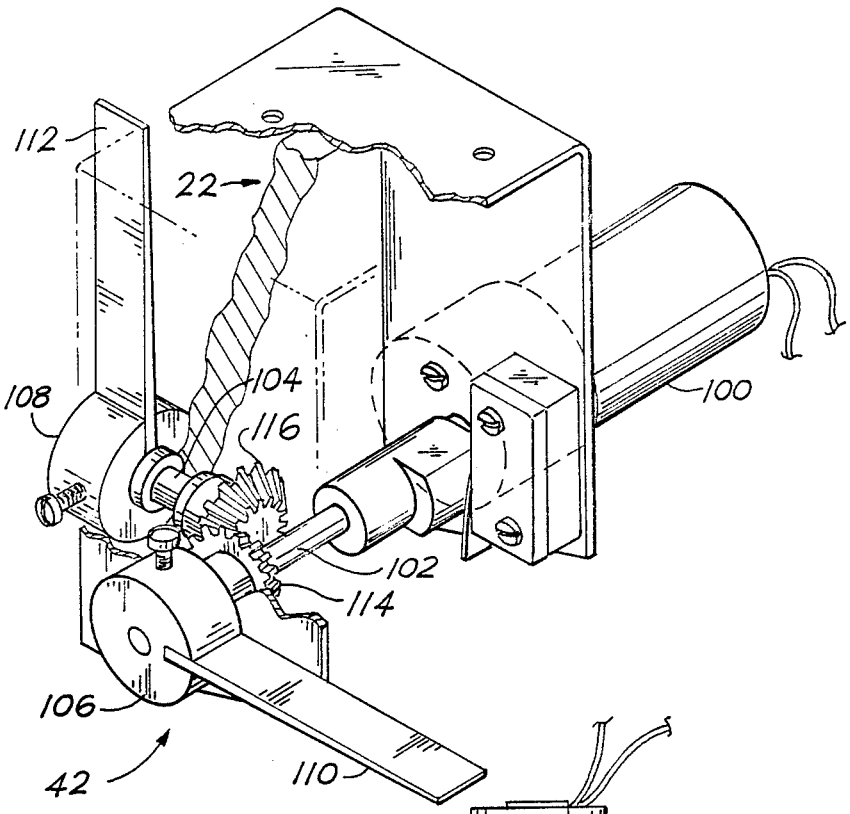
FIG. 8 is a perspective view of the jogging means shown in FIGS. 2, 3 and 7.
Figure 9:
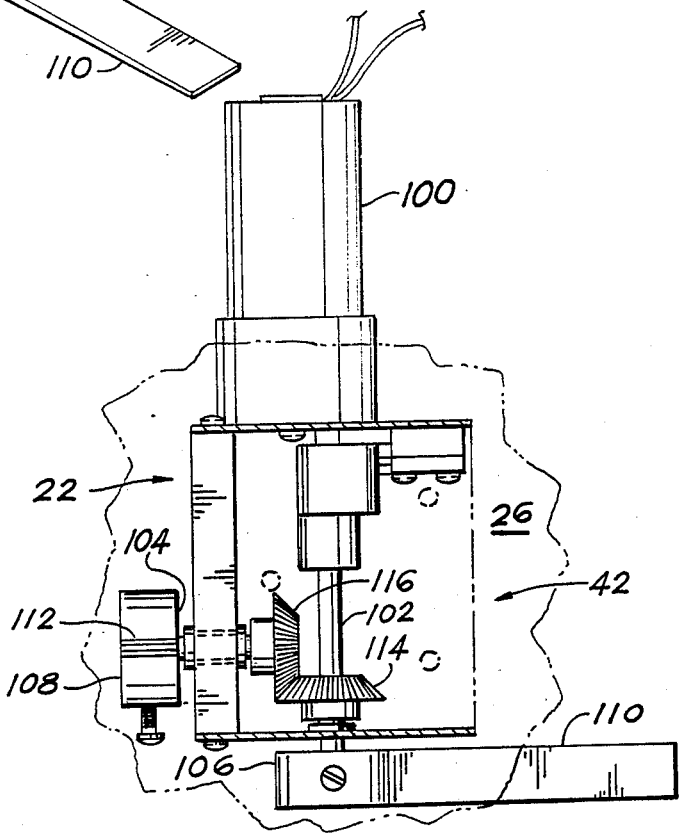
FIG. 9 is an enlarged partial bottom plan view of the jogging means.

Positioned near the top of entrance wall 28 is an entrance opening 48. Entrance opening 48 is an elongated rectangular slot through which paper sheets may enter the enclosure from a feeding or supply source. Commonly, the feeding or supply source is a large capacity, high-speed, printing or duplicating device. Upon entering the enclosure through entrance opening 48, the sheets are directed by a sheet guiding means 50 onto conveying means 36. For clarity of the other features within the invention, sheet guiding means 50 is not illustrated in FIGS. 2–4, or 12. However, sheet guiding means 50 is shown in FIGS. 5 and 6. Slots are cut out of sheet guiding means 50 to enable the insertion of driving tires 54 and 58, crowned tires 68, and recessed tires 70.

Conveying means 36 conveys the sheets through the enclosure along a conveying path 51 and regulates the speed at which the sheets are delivered to beam strengthening means 38 and tray assembly 40. Controlling the sheet delivery speed is important to ensure that jogging means 42 properly engages the sheets within tray assembly 40.

Conveying means 36, as illustrated in FIGS. 2, 3, 4, 5 and 12, is a positive drive mechanism secured to support frame 22 and located adjacent to entrance opening 48. Conveying means 36 comprises: a pair of forward pinch rollers 52 having a plurality of driving tires 54; a pair of rearward pinch rollers 56 having a plurality of driving tires 58; a powered, rotating driving motor 60; a continuous drive belt 62 trained about the rotating shaft of driving motor 60 and one of the rearward pinch rollers 56; and a continuous drive belt 64 trained about one of the rearward pinch rollers 56 and one of the forward pinch rollers 52.

Forward and rearward pinch rollers 52, 56 are rotatably secured to support frame 22, with forward pinch rollers 52 being located within the enclosure in close proximity to entrance opening 48, and rearward pinch rollers 56 being located further within the enclosure along the conveying path 51. To prevent jamming of apparatus 20, the length of the paper, as measured in the direction of conveying path 51, should exceed the distance between forward pinch rollers 52 and rearward pinch rollers 56. Otherwise, the sheets might become jammed between forward pinch rollers 52 and rearward pinch rollers 56. Both forward and rearward pinch rollers 52, 56 extend within the enclosure substantially across the entire width of entrance opening 48.

Forward pinch rollers 52, rearward pinch rollers 56, and driving motor 60 are positioned to cause drive belts 62 and 64 to be adjustably and rotatably taut. The position of drive belts 62 and 64 may be maintained by providing a crown at the location where each belt contacts each roller or driving motor shaft, or by provided raised guides to restrict the sideways movement of each belt. Rotation of driving motor 60 causes the rotation of drive belts 62 and 64, forward and rearward pinch rollers 52, 56, and driving tires 54 and 58.

Sheet guiding means 50 initially guides the sheets toward the nips of driving tires 54. The sheets are engaged between the nips of driving tires 54 and are conveyed, with the continued assistance of sheet guiding means 50, along conveying path 51 toward the nips of driving tires 58 and beam strengthening means 38. The sheets are then engaged between the nips of driving tires 58 which convey the sheets through beam strengthening means 38 and deposit the sheets within tray assembly 40.

Driving tires 54 and 58 exert minimal but sufficient pressure to convey the sheets through the enclosure. Excessive pressure might crease, mark or smear the conveyed sheets and should be avoided. Preferably, driving tires 54 and 58 have a tacky outer surface, and may be made of an elastomer.

As the sheets enter and pass through beam strengthening means 38 a sheet-jamming or sheet-delivery sensing means 66 is used to verify proper sheet feeding or depositing of the sheets within tray assembly 40. A light activated switch, and a delivery optical path through which the sheets pass, may serve as sheet-delivery sensing means 66. When triggered, sheet-delivery sensing means 66 may cause the engagement of an operator warning signal and terminate the operation of apparatus 20. Sheet-delivery sensing means 66 may also serve to activate jogging means 42.

Beam strengthening means 38 is used to give the sheets beam strength so that they will cantilever into the enclosure as they are being deposited within tray assembly 40. Beam strengthening means 38 recurls or bends the sheets to give the sheets beam strength as they pass between rearward pinch rollers 56. Beam strengthening means 38 greatly reduces jamming of the sheets within tray assembly 40 by preventing the sheets from rolling up on the receiving surface of the tray assembly 40.

Beam strengthening means 38 comprises two matched pairs of crowned and recessed tires 68, 70 which may be positioned coincidently with rearward pinch rollers 56. For convenience and lower manufacturing cost, crowned and recessed tires 68, 70 may be securely attached to rearward pinch rollers 56. In the preferred embodiment, driving tires 58 are located between the two pairs of crowned and recessed tires 68, 70. Recessed tires 70 are located beneath and in close proximity to crowned tires 68. The conveyed sheets are directed by sheet guiding means 50 onto the nips of the matched crowned and recessed tires 68, 70 to pass therebetween. Sufficient space is allowed between crowned and recessed tires 68, 70 to bend the sheets but not exert a significant forward driving force on the sheets. Instead, driving tires 58 convey the sheets through beam strengthening means 38. This configuration eliminates the snapping noise, which would otherwise be present, of the sheets as they leave beam strengthening means 38, thus maintaining a low operational noise level. This configuration also prevents the crowned and recessed tires 68, 70 from creasing, marking, or smearing the sheets as they sheets pass through beam strengthening means 38. After the sheets are fed through beam strengthening means 38, rearward pinch rollers 56 direct the recurled sheets toward tray assembly 40.

Located in close proximity to beam strengthening means 38 is a paper bail means comprising a pair of paper bails 72 Paper bails 72 serve the following dual purposes: to direct the incoming sheets onto the receiving surface of tray assembly 40; and to ensure the proper orientation and direction of the sheets after they are deposited by holding the deposited sheets against the sheet stack. Paper bails 72 prevent the sheets from rebounding away from the stopping means, combat curl, and help the sheets in the stacks to maintain their jogged alignment.

As the sheets leave beam strengthening means 38, driven by rearward pinch rollers 56, the cantilevered sheets are directed downward by gravity and by paper bails 72 until the sheets are juxtaposed between the receiving surface of tray assembly 40 and paper bails 72. Paper bails 72 are pivotally secured to support frame 22 and may be counterbalanced with weights 73 or supported by springs so that paper bails 72 do not rest too heavily upon the sheet receiving surface.

Tray assembly 40 is secured to support frame 22 and positioned below paper bails 72. Tray assembly 40 and elevating means 78 act together to provide a large capacity, self-leveling depository into which the sheets are stacked. Tray assembly 40 comprises: a substantially horizontal tray floor 76 whereupon the sheets are stacked; an elevating means 78 to properly position the receiving surface in close proximity to beam strengthening means 38; and a tray side wall, defining a first stationary stopping means 80, against which the sheets may be urged. Initially, tray floor 76 is the sheet receiving surface. However, once a sheet is deposited within tray assembly 40, the top of the sheet stack serves as the sheet receiving surface.

Figure 11:
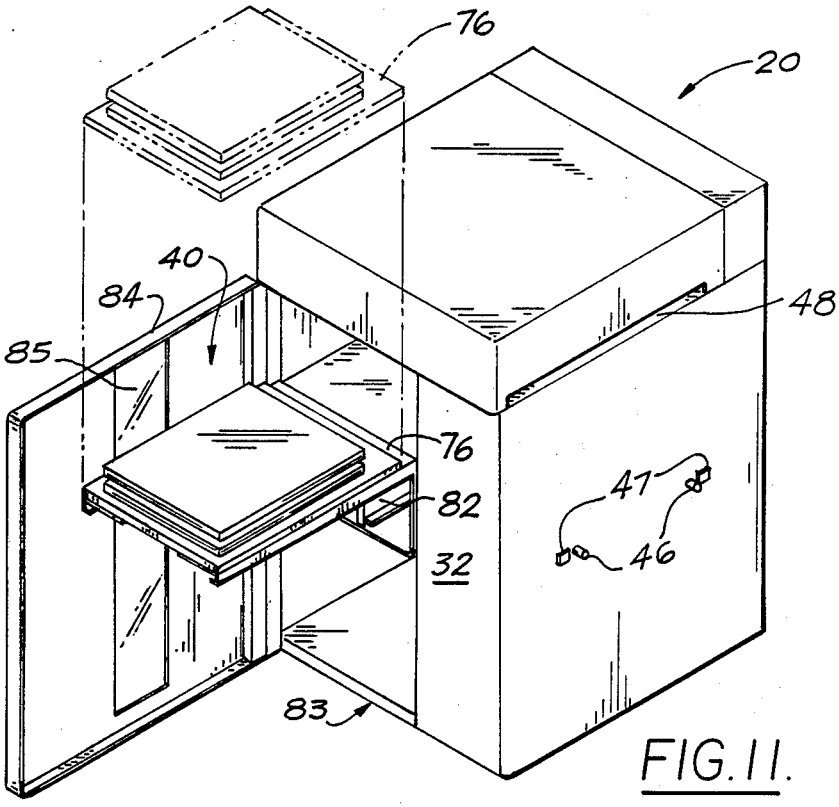
FIG. 11 is a perspective view of the present invention as shown in FIG. 1 with a removable tray floor.
Figure 12:
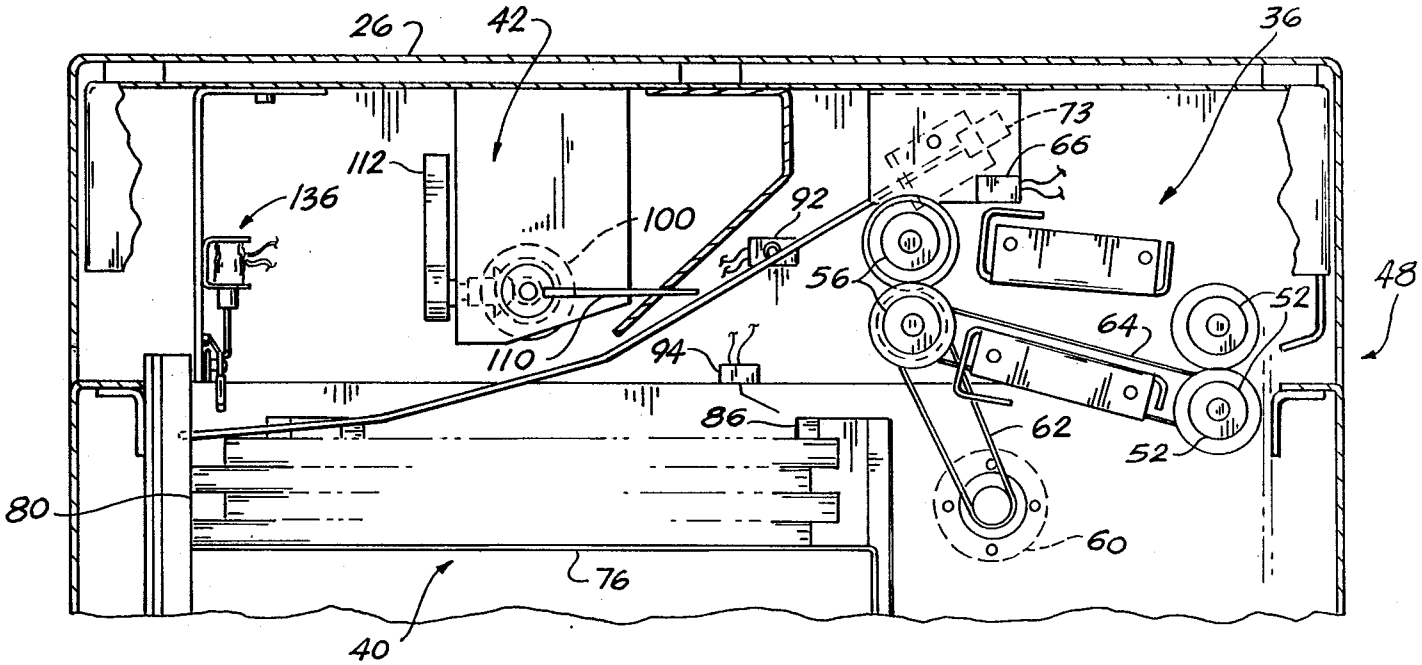
FIG. 12 is an enlarged partial side elevational view of the present invention as shown in FIG. 3.
Figure 13:
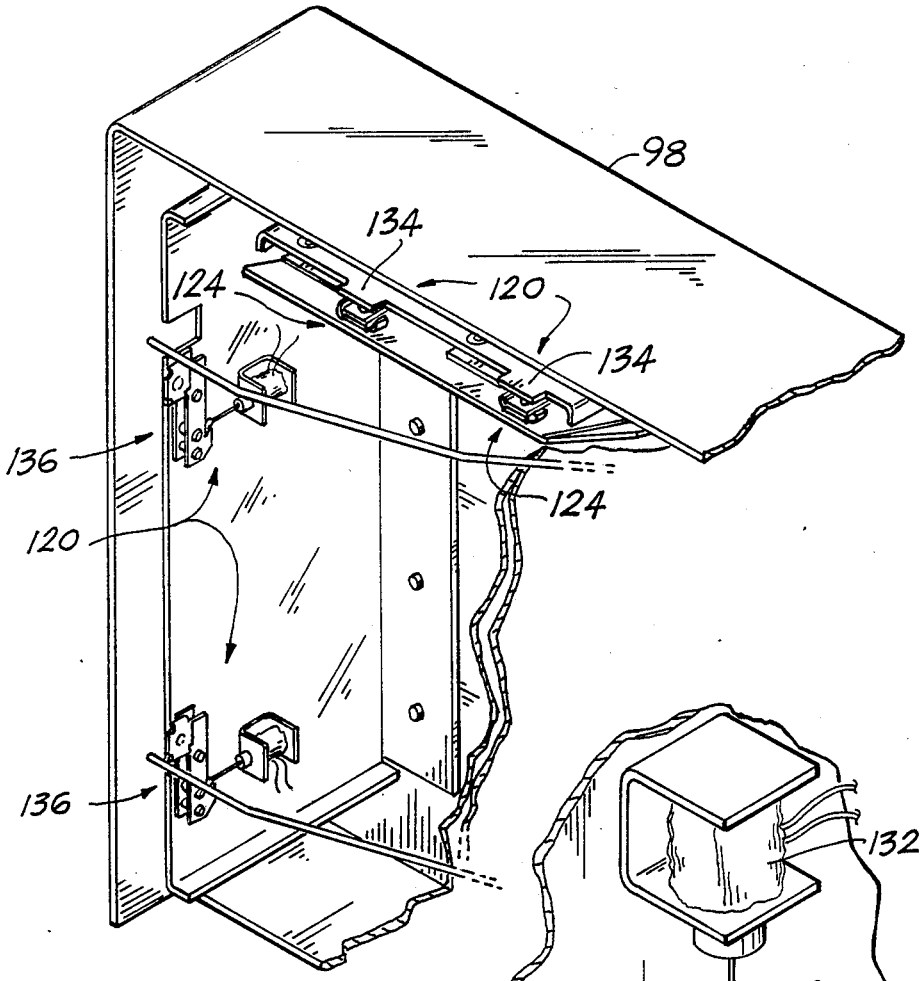
FIG. 13 is a partial perspective view of the first and second solenoid-driven stopping means.

As shown in FIG. 11, tray floor 76 may be placed upon drawer-type slides 82 to facilitate easy removal of the stacked sheets from within the enclosure through an access door opening 83 in front wall 32. Tray floor 76 may also be removable, allowing the removal and replacement of alternative tray floors 76. Access door opening 83 is covered during operation of apparatus 20 by access door 84. Access door 84 may have a window 85 through which the separated job stacks may be visually inspected during the operation of apparatus 20. To enable tray assembly 40 to contain large quantities of stacked sheets, tray floor 76 is movably supported by elevating means 78.

Figure 3:
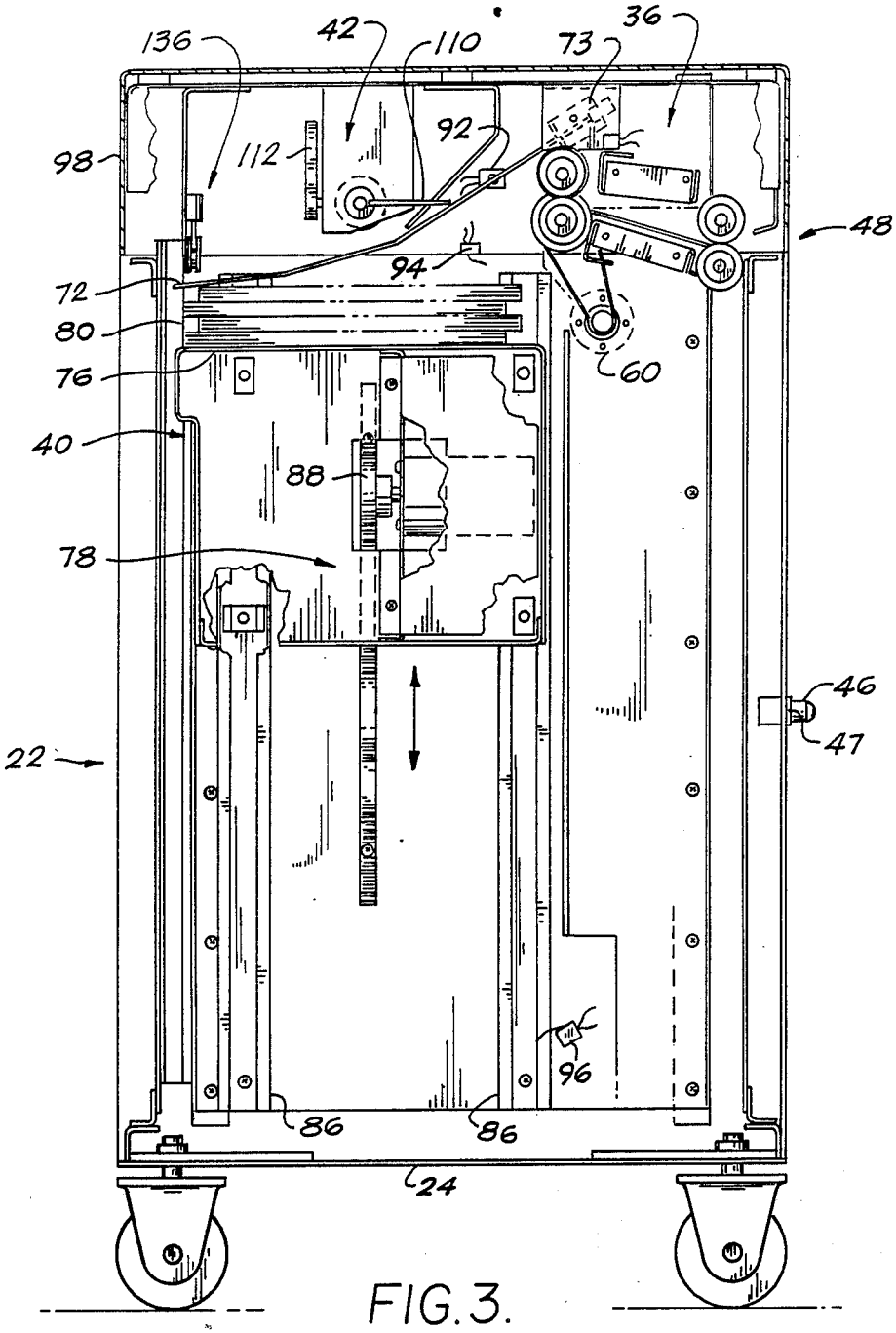
FIG. 3 is a side elevational view of the present invention as shown in FIGS. 1 and 2 with the canopy lowered and portions of the side broken away to reveal the internal mechanisms.

Elevating means 78 supports tray floor 76 and raises or lowers the elevation of tray floor 76 so that the top of the stack of sheets or tray receiving surface remains in close proximity to the cantilevered sheets and beam strengthening means 38. Elevating means 78, as shown in FIGS. 3 and 4, comprises: a tracking means 86 located on back wall 34 of support frame 22; a rack and pinion drive means 88, also located on back wall 34; a powered elevational motor 90 located beneath tray floor 76; and a sheet-elevation sensing means 92.

Tracking means 86 allows tray floor 76 to be raised or lowered within the enclosure in a generally vertical manner.

Rack and pinion drive means 88 is driven by powered elevational motor 90 to raise and lower tray floor 76 in a vertically-indexed manner.

Sheet-elevation sensing means 92, is triggered by the increasing height of the stack to activate elevational motor 90 as needed to raise or lower the tray floor 76 along tracking means 86 until the sheet receiving surface is located at the proper elevation. Initially, an upper trip switch 94 determines the proper elevation of the sheet receiving surface. Thereafter, proper elevation is determined by the location of paper bails 72. In the preferred embodiment, sheet-elevation sensing means 92 may include a second light activated switch having an elevational optical path. The raising and lowering of paper bails 72 interrupts the continuity of the elevational optical path to trigger the raising or lowering of tray floor 76 by rotation of the pinion engaged in the rack of rack and pinion drive means 88. During operation of apparatus 20, tray floor 76 is lowered at incremented distances as the sheet stack increases in height. This procedure of raising and lowering tray floor 76 continues until a bin-full or capacity sensing means 96 is triggered.

Capacity sensing means 96 may comprise a trip switch attached to support frame 22 which is engaged or disengaged by its proximity to tray floor 76. When activated, capacity sensing means 96 may engage another operator warning signal and terminate the operation of apparatus 20 until the stacked sheets are removed from tray assembly 40. In the preferred embodiment, tray assembly 40 is capable of receiving about 2,500 sheets before capacity sensing means 96 is activated and removal of the sheets is necessary.

A time delay is provided after sheet-delivery sensing means 66 indicates that a sheet has properly passed the delivery optical path. The time delay allows for the proper deposition of the sheets within tray assembly 40 before jogging means 42 is activated.

Soon after the sheets become deposited upon the receiving surface of tray assembly 40, jogging means 42 jogs the sheets into physically separated, easily defined, aligned job stacks. Jogging is accomplished by a motor driven jogging means 42 which is secured to support frame 22 above and in close proximity to the tray receiving surface. One embodiment of jogging means 42 of this invention is disclosed in the commonly assigned, copending U.S. patent application, Ser. No. 078,254, titled "DUAL TOTE SORTER AND STACKER".

Jogging means 42 may be positioned upon a hinged or pivotal canopy 98 which in turn is attached to support frame 22. Pivotal canopy 98 allows jogging means 42 to pivot or lift away from tray assembly 40. This facilitates easy access to conveying means 36, tray assembly 40, and jogging means 42 for maintenance of apparatus 20 and for the removal of any sheets which might become jammed within the enclosure. In the preferred embodiment, a single safety switch 99, triggered by a breach of magnetic continuity, is attached to either support frame 22, access door 84, or canopy 98. Safety switch 99 activates an appropriate operator warning device and terminates the operation of apparatus 20 if either canopy 98 or access door 84 are opened.

Jogging means 42 comprises: a powered jogging motor 100 securely attached to lid 26 of support frame 22; a rotatable primary shaft 102; a rotatable auxiliary shaft 104; a primary chuck 106; an auxiliary chuck 108; and a primary and an auxiliary flexible, elastomeric, jogging finger 110, 112.

Primary shaft 102 is rotationally secured to lid 26 of support frame 22 and is securely attached to the rotational shaft of jogging motor 100. Auxiliary shaft 104 is likewise rotationally secured to lid 26 and is rotatably interconnected to primary shaft 102 through a pair of meshed beveled gears 114, 116. Beveled gear 114 is securely attached to primary shaft 102. Beveled gear 116 is securely attached to auxiliary shaft 104. The rotational axes of primary shaft 102 and auxiliary shaft 104 are preferably positioned perpendicular to one another, and parallel to the receiving surface of tray assembly 40. If desirable, the rotational axes may be positioned at a slight angle to the receiving surface of tray assembly 40.

Primary and auxiliary jogging fingers 110, 112 are respectively mounted in primary and auxiliary chucks 106, 108. Primary and auxiliary jogging fingers 110, 112 may have any convenient cross-sectional shape and may be tapered. The preferred embodiment uses identical jogging fingers having a tapered rectangular shape. The jogging fingers are preferably between two and six inches in length and are very flexible. The jogging fingers also have a tacky or "sticky" quality toward paper. The jogging fingers may be constructed of an elastomer, such as polyurethane having a durometer hardness of about 60. Other suitable material which will gently move the top sheet of a stack may also be used. The jogging fingers are preferably located over the approximate center of the sheets being deposited within tray assembly 40 so that equivalent moving forces are applied to the top sheet in both rotational directions used to jog the sheets.

Primary and auxiliary chucks 106, 108 are respectively mounted upon primary shaft 102 and auxiliary shaft 104 in a manner that primary jogging finger 110 is rotationally offset by 90 degrees from auxiliary jogging finger 112. In other words, primary and auxiliary chucks 106, 108 are respectively secured to primary shaft 102 and auxiliary shaft 104 such that when one jogging finger is located within a vertical plane, the other jogging finger is located within a horizontal plane.

The rotation of the rotational shaft of jogging motor 100 causes primary jogging finger 110 and auxiliary jogging finger 112 to rotate once or twice for each deposited sheet, urging the top sheet against either a first set or a second set of two orthogonally oriented stopping means 118, 120. When the jogging fingers contact the surface of the top sheet, their unique movement of bending and possibly pivoting forces the sheet against the appropriate, properly positioned set of stopping means.

Figure 10:
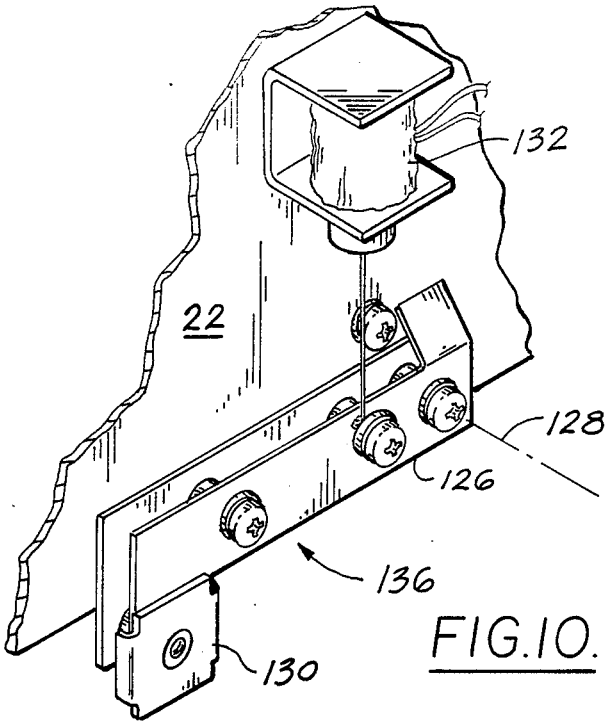
FIG. 10 is a partial perspective view of the second solenoid-driven stopping means as shown in FIGS. 2, 3 and 7.
Figure 14:
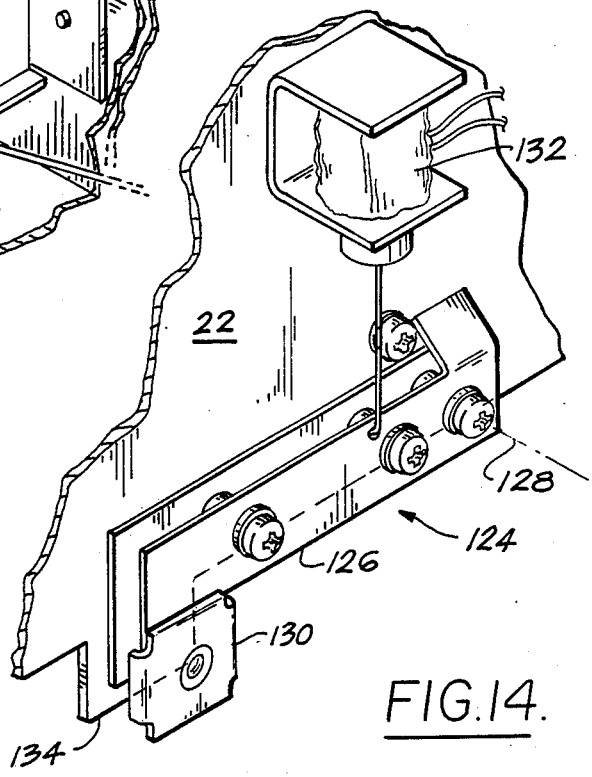
FIG. 14 is a partial perspective view of the first solenoid-driven stopping means as shown in FIGS. 2, 3 and 7.

The sheets of the first job stack, and each alternative job stack thereafter, are registered against the first set of orthogonally oriented stopping means 120 which includes: a first stationary stopping means 80; and a lowered, first solenoid-driven stopping means 124. The tray side wall serves as first stationary stopping means 80 which is located on the opposite side of the sheet receiving surface from beam strengthening means 38. First solenoid-driven stopping means 124, as illustrated in FIG. 14, comprises: a pivotal arm 126 which is pivotally mounted to support frame 22 to pivot about axis 128; a weighted paper stop 130 attached to pivotal arm 126; and a solenoid 132, attached to support frame 22, which causes pivotal arm 126 to pivot about axis 128. Second solenoid-driven stopping means 136, as illustrated in FIG. 10, has the same identical components or elements as first solenoid-driven stopping means 124. Initially, solenoid 132 is disengaged to permit pivotal arm 126 to rotate by gravity such that paper stop 130 extends downward into conveying path 51 to rest upon the receiving surface of tray assembly 40. When disengaged, first solenoid-driven stopping means 124 serves a dual purpose: to define a stop against which the sheets in that particular job stack will be registered; and to hold the top sheet of the lower job stack quiescent while the next sheet is offset from the previous job stack, which is important to ensure accurate job separation. First solenoid-driven stopping means 124 is inset slightly toward the center of the sheet receiving surface from a second stationary stopping means 134 which is located near access door opening 83.

The sheets of the second job stack, and each alternative job stack thereafter, are registered against the second set of orthogonally oriented stopping means 120 which include: second stationary stopping means 134; and a lowered, second solenoid-driven stopping means 136. A protrusion of support frame 22 from lid 26, located near access door opening 83, extends downward below the sheet receiving surface of tray assembly 40 to serve as second stationary stopping means 134. Solenoid 132 of first solenoid-driven stopping means 124 must be engaged to raise pivotal arm 126 and paper stop 130 away from the receiving surface of tray assembly 40 to enable the sheets to be registered against second stationary stopping means 134. Second solenoid-driven stopping means 136 has the same configuration, parts, and function as first solenoid-driven stopping means 124, except that second solenoid-driven stopping means 136 is inset slightly toward the center of the sheet receiving surface from first stationary stopping means 80.

When the sheets are to be registered against first stationary stopping means 80, the solenoid of second solenoid-driven stopping means 136 engages to pivot its paper stop out of conveying path 51. Once the first job stack has been completed, the solenoid is disengaged to permit the pivotal arm to rotate by gravity such that the paper stop of second solenoid-driven stopping means 136 extends downward into conveying path 51 to rest upon the receiving surface of tray assembly 40. Second solenoid-driven stopping means 136 serves to define a stop against which the sheets in that particular job stack will be registered, and holds the top sheet of the lower job stack quiescent while the sheets of the next job stack are deposited and jogged.

In the preferred embodiment, dual first solenoid-driven stopping means 124 and dual second solenoid-driven stopping means 136 are used. A means, such as a spring, may also be used to bias the paper stops of disengaged first and second solenoid-driven stopping means 124, 136 onto the paper receiving surface.

The operational and functional relationship between each element of the present invention can be readily ascertained by reference to the following example of its use.

A sheet is introduced into entrance opening 48 of the enclosure and is engaged between the nip of driving tires 54 on forward pinch rollers 52. Forward pinch rollers 52 feed the sheet, assisted by sheet guiding means 50, toward the nip of driving tires 58 on rearward pinch rollers 56 and beam strengthening means 38. Once engaged between driving tires 58, the sheet is conveyed at a regulated speed through beam strengthening means 38. Beam strengthening means 38 bends the sheet, giving the sheet beam strength. The sheet passes between rearward pinch rollers 56 and beam strengthening means 38 to cantilever over the receiving surface of tray assembly 40.

Paper bails 72, with the assistance of gravity, direct and force the sheets downward onto the sheet receiving surface. Paper bails rest upon the top of the stack of sheets deposited within tray assembly 40. When a predetermined increase in the height of the sheet stack is reached, paper bails 72 interrupt an elevational optical path to trigger capacity sensing means 96, which in turn engages elevating means 78. Elevational motor 90 rotates to engage rack and pinion drive means 88 and appropriately propel tray floor 76 either upward or downward along tracking means 86 until the sheet receiving surface is at the proper height to receive the incoming sheets.

As the sheet enters and exits beam strengthening means 38, the sheet engages and disengages sheet-delivery sensing means 66. Sheet-delivery sensing means 66 triggers the engagement of jogging means 42 after a sufficient time has passed to allow the sheet to become deposited onto the sheet receiving surface.

Once activated, jogging motor 100 of jogging means 42 rotates a selected number of revolutions to cause primary and auxiliary jogging fingers 110, 112 to contact and lightly sweep across the sheet a given number of times. Preferably each jogging finger only contacts the sheet once or twice. Where the jogging fingers wipe across the sheet twice, primary jogging finger 110 urges the sheet against either first stationary stopping means 80 or second solenoid-driven stopping means 136. The auxiliary jogging finger then urges the sheet against either the corresponding first solenoid-driven stopping means 124 or second stationary stopping means 134. Primary jogging finger 110 again urges the sheet against either first stationary stopping means 80 or second solenoid-driven stopping means 136 to correct any rebounding that may have occurred and to ensure proper alignment of the sheet within the stack. Finally, auxiliary jogging finger 112 again urges the sheet against either the corresponding first solenoid-driven stopping means 124 or second stationary stopping means 134 for the same reasons. In effect, the sheet is twice jogged in two directions. Each of these successive steps is repeated for each sheet deposited onto tray assembly 40 for that job stack.

After all of the sheets in a job stack have been deposited and properly registered or aligned, that particular set of orthogonally oriented stopping means is automatically replaced with the other set of stopping means. For example, if the first set of stopping means 118 had just been used against which a job stack had been registered, a second set of stopping means 120 would next be engaged to rest upon the uppermost sheet in that job stack, and the necessary parts of the first set of stopping means 118 are raised off of the sheet receiving surface. The sheets of the next job stack are then urged against the second set of stopping means 120.

The described jogging technique, of jogging the sheets of each successive job stack against alternating stopping means, is continued with the sheets of alternating job stacks being registered against the same set of orthogonally oriented stopping means. The end result is a stack of sheets wherein each individual job stack is physically offset about an inch to one half of an inch in two directions from the job stack immediately below and above it.

In compliance with the statute, the invention has been described in language generally specific to structural features. Since the means and construction herein disclosed comprise the preferred form of putting the invention into effect, it is to be understood the invention is not limited to the specific features shown herein. The invention is, therefore, claimed in any of its forms or modifications within the legitimate and valid scope of the appended claims, appropriately interpreted in accordance with the doctrine of equivalents.

INDUSTRIAL APPLICABILITY

This invention is particularly adapted for the semi-continuous stacking and jogging of large quantities of paper sheets as often needed for the effective use of large mainframe or commercial printing and duplicating equipment. Provisions are made for conveying, giving the sheets beam strength, stacking, and jogging the sheets into physically separated and distinct job stacks within the apparatus.

We claim:

1. An apparatus for stacking and jogging sheets into a stack comprising the combination of:

(a) a support frame defining an enclosure, said enclosure having an entrance opening for entry of said sheets into said enclosure, said enclosure having an access door opening for removal of said sheets from said enclosure;

(b) a conveying means secured to said support frame within said enclosure for conveying said sheets along a delivery path from said entrance opening to said stack;

(c) a beam strengthening means comprising at least one matched pair of crowned and recessed tire sets between which said sheets are passed by said conveying means, each of said crowned tires being juxtaposed to, but slightly spaced apart from one of said recessed tires, whereby said crowned and recessed tires cooperate to bend said sheets along two separated but parallel axes to give said sheets beam strength as said sheets pass therebetween for deposit within said enclosure;

(d) a tray assembly attached to said support frame within said enclosure, said tray assembly receiving said sheets from said conveying means and said beam strengthening means, said tray assembly having a sheet receiving surface upon which said sheets are received;

(e) an elevating means attached to said support frame within said enclosure, said elevating means maintaining said sheet receiving surface near said conveying means and said beam strengthening means during operation of said apparatus; and (f) jogging means having at least one elongated, flexible jogging finger rotatably secured to said support frame within said enclosure, wherein each said jogging finger is rotated into contact with the upper surface of each of said sheets after each sheet is deposited upon said receiving surface, and wherein each said jogging finger rotates to contact each of said sheets in a wiping movement to successively jog each of said sheets against at least one set of orthogonally oriented stopping means.

2. The apparatus of claim 1, wherein said jogging finger rotates only a limited number of complete turns for each deposited sheet.

3. The apparatus of claim 1, further comprising: (1) at least one hinged paper bail attached to said support frame and resting upon said receiving surface for directing said sheets from said conveying means and said beam strengthening means toward said receiving surface; (2) a light sensitive sheet elevation sensing switch secured to said support frame, a light source, and an elevational optical path therebetween; whereby said paper bail interrupts said elevational optical path, by traversing said elevational optical path when said receiving surface is not located below and in close proximity to said conveying means and said beam strengthening means, to cause said light sensitive switch to signal said elevating means to raise or lower said receiving surface in a vertically indexed manner to restore said receiving surface to a position below and in close proximity to said conveying and beam strengthening means.

4. The apparatus of claim 1, further comprising a securing means secured to said support frame for securing said apparatus to a supply source of said sheets, wherein said securing means comprises one or more magnets for holding said apparatus to said supply source and one or more locating pins for aligning said apparatus to said source.

5. The apparatus of claim 1, wherein the tires of each set of said crowned and recessed tires are spaced apart by a distance substantially the same as the thickness of one of said sheets.

6. The apparatus of claim 1, wherein said jogging means comprises an elongated, flexible primary jogging finger and an elongated, flexible auxiliary jogging finger each rotatably secured to said support frame within said enclosure, said primary and said auxiliary jogging fingers being discontinuously rotated in alternation about separate axes and thereby into contact with the upper surface of each of said sheets to jog each of said sheets against said set of orthogonally oriented stopping means from two different directions.

7. The apparatus of claim 6, wherein said primary jogging finger and said auxiliary jogging finger are rotated by a single jogging motor about axes which are substantially perpendicular to one another.

8. The apparatus of claim 1, said jogging means further having a first set of orthogonally oriented stopping means and, offset and noncongruent to said first set, a second set of orthogonally oriented stopping means.

9. The apparatus of claim 8, wherein said first set of stopping means has a first stationary stopping means and a first solenoid-driven stopping means, and said second set of stopping means has a second stationary stopping means and a second solenoid-driven stopping means, said first solenoid-driven stopping means being orthogonally oriented to said first stationary stopping means and inset toward the center of said receiving surface from said second stationary means, said second solenoid-driven stopping means being orthogonally oriented to said second stationary stopping means and inset toward the center of said receiving surface from said first stationary means, said first solenoid-driven stopping means resting upon said receiving surface and said second solenoid-driven stopping means being raised away from said receiving surface when said sheets are being jogged against said first set of stopping means, said second solenoid-driven stopping means resting upon said receiving surface and said first solenoid-driven stopping means being raised away from said receiving surface when said sheets are being jogged against said second set of stopping means, thereby allowing the separation of said sheets into physically separated job stacks by alternating between said first and said second sets of stopping means after each job stack has been deposited.

10. The apparatus of claim 1 further comprising a sheet-delivery sensing means secured to said support frame for sensing the passage of each of said sheets from said conveying means to said tray assembly and, when passage is sensed, for signalling the start of rotation of said jogging finger after a time delay but, when a sheet is sensed but passage is not sensed, for causing engagement of an operator warning signal.

11. The apparatus of claim 10, wherein said sheet-delivery sensing means comprises a light-sensitive switch and a light source having an optical path therebetween, said optical path traversing said delivery path within said conveying means.

12. The apparatus of claim 1, wherein said conveying means comprises at least one pair of powered pinch rollers rotatably secured to said support frame within said enclosure between said entrance opening and said tray assembly, said pair of pinch rollers for conveying said sheets into said enclosure, and wherein said matched pair of crowned and recessed tire sets is mounted upon and coaxial with one of said pair so pinch rollers.

13. The apparatus of claim 12 comprising two pairs of powered pinch rollers, both pairs turning identically at a regulatable conveying speed along mutually parallel axes, wherein said matched pair of crowned and recessed tires is mounted upon an innermost of said pairs of pinch rollers.

14. The apparatus of claim 12, further comprising a sheet guiding means secured to said support frame for guiding said sheets toward said pinch rollers and said beam strengthening means.

15. In an apparatus for jogging individually fed sheets into distinct job stacks, said apparatus having a support frame with a receiving tray surface and a jogging means to jog successively fed sheets into said job stacks, the improvement comprising:

a dual orthogonal stop system wherein said stop system further comprises a first set of stops having a first stationary stop and a first solenoid driven stop, and a second set of stops having a second stationary stop and a second solenoid driven stop, wherein said first solenoid driven stop is orthogonally oriented to said first stationary stop and inset toward the center of said receiving surface from said second stationary stop, and wherein said second solenoid driven stop is orthogonally oriented to said second stationary stop and inset toward the center of sid receiving surface from said first stationary stop, said first solenoid driven stop resting upon said receiving tray surface or a top surface of one of said job stacks and said second solenoid driven stop being raised away from said tray surface or said top surface when said sheets are jogged against said first set of stops to complete a new job stack, said second solenoid driven stop resting upon a top surface of said new stack and said first solenoid driven stop being raised away from said top surface of said new stack when said sheets are being jogged against said second set of stops, thereby alternating between said first and said second sets of stops after each job stack has been deposited.

16. A jogging apparatus for jogging individually fed sheets into distinct job stacks comprising the combination of: a powered, elongated, flexible primary jogging finger and a powered, elongated, flexible auxiliary jogging finger, each rotatably secured to a support frame having a receiving surface, said primary and said auxiliary jogging fingers being rotated into alternating contact with the upper surface of each of said sheets as said sheets are deposited upon said receiving surface, said primary and said auxiliary jogging fingers rotating to contact said sheets in a wiping movement and jog said sheets against either a first set of orthogonally oriented stopping means or a second set of orthogonally oriented stopping means such that the jogging fingers do not continually rotate, said first and said second set of stopping means being non-coincidental.

17. The apparatus of claim 16, wherein said primary and said auxiliary jogging fingers are rotated by a single jogging motor about axes which are substantially perpendicular to one another.

18. The apparatus of claim 16, wherein said first set of stopping means has a first stationary stopping means and a first solenoid-driven stopping means, and said second set of stopping means has a second stationary stopping means and a second solenoid-driven stopping means, said first solenoid-driven stopping means being orthogonally oriented to said first stationary stopping means and inset toward the center of said receiving surface from said second stationary means, said second solenoid-driven stopping means being orthogonally oriented to said second stationary stopping means and inset toward the center of said receiving surface from said first stationary means, said first solenoid-driven stopping means resting upon said receiving surface and said second solenoid-driven stopping means being raised away from said receiving surface when said sheets are jogged against said first set of stopping means, said second solenoid-driven stopping means resting upon said receiving surface and said first solenoid-driven stopping means being raised away from said receiving surface when said sheets are being jogged against said second set of stopping means, thereby allowing the separation of said sheets into physically separated job stacks by alternating between said first and said second sets of stopping means after each job stack has been deposited.

19. The apparatus of claim 16, wherein each primary and said auxiliary jogging fingers each rotate only a limited number of complete turns for each of said sheets deposited upon said receiving surface.

20. The apparatus of claim 19 wherein said limited number of rotations is one or two.

21. A method of stacking and jogging sheets into job stacks comprising the steps of:

(a) conveying each of said sheets to a receiving surface at an elevation, whereon it is deposited;

(b) for each of said job stacks, jogging each of said sheets against either a first set of orthogonally oriented stopping means or a second set of orthogonally oriented stopping means, wherein said first set of stopping means is not congruently positioned with respect to said second set;

(c) lowering said receiving surface to substantially maintain said elevation of said receiving surface as said sheets are deposited.

22. The method of claim 21 wherein said step of jogging further comprises the steps of sensing delivery of each of said sheets to said receiving surface and initiating a limited number of alternating jogs from two jogging fingers each of which rotates about a separate axis.

23. The method of claim 21 further comprising the step of passing said sheet through a beam strengthening means while said sheet is being conveyed toward said receiving surface.

24. The method of claim 23, wherein said first set of stopping means has a first stationary stopping means and a first solenoid-driven stopping means, and said second set of stopping means has a second stationary stopping means and a second solenoid-driven stopping means, said first solenoid-driven stopping means being orthogonally oriented to said first stationary stopping means and inset toward the center of said receiving surface from said second stationary means, said second solenoid-driven stopping means being orthogonally oriented to said second stationary stopping means and inset toward the center of said receiving surface from said first stationary means, said first solenoid-driven stopping means resting upon said receiving surface and said second solenoid-driven stopping means being raised away from said receiving surface when said sheets are jogged against said first set of stopping means, said second solenoid-driven stopping means resting upon said receiving surface and said first solenoid-driven stopping means being raised away from said receiving surface when said sheets are being jogged against said second set of stopping means.

* * * * *

UNITED STATES PATENT AND TRADEMARK OFFICE

CERTIFICATE OF CORRECTION

PATENT NO. : 4,890,825

DATED : January 2, 1990

INVENTOR(S) : McCormick et al.

It is certified that error appears in the above—identified patent and that said Letters Patent is hereby corrected as shown below:

Column 17, line 55 "pair so" should read --pairs of--.

Column 18, line 15 "sid" should read --said--.

Signed and Sealed this

Twenty-ninth Day of January, 1991

*Attest:*

*Attesting Officer*

HARRY F. MANBECK, JR.

*Commissioner of Patents and Trademarks*